United States Patent [19]

Gibbons

[11] Patent Number: 4,553,753

[45] Date of Patent: Nov. 19, 1985

[54] ANGULAR HOCKEY STICK GRIP

[76] Inventor: Gerald F. Gibbons, 9610 51st Pl., College Park, Md. 20740

[21] Appl. No.: 592,311

[22] Filed: Mar. 22, 1984

Related U.S. Application Data

[63] Continuation-in-part of Ser. No. 552,896, Nov. 17, 1983, abandoned, which is a continuation-in-part of Ser. No. 526,288, Aug. 25, 1983, abandoned.

[51] Int. Cl.[4] ..... A63B 59/12

[52] U.S. Cl. ..... 273/67 A; 273/162 B

[58] Field of Search ..... 273/67 R, 67 A, 67 B, 273/67 C, 67 D, 67 DA, 67 DB, 67 DC, 81.3, 81.13, 73 J, 75, 81.2, 81 D, 165, 162 B; D21/210, 211, 213, 222; 135/76; 16/114 R, 114 A, 110 R; D8/321, 327, DIG. 4–10; 145/108 R, 108 A, 108 B; 30/257, 260; 74/551.1, 551.8, 551.9

[56] References Cited

U.S. PATENT DOCUMENTS

| | | | |
|---|---|---|---|
| D. 182,359 | 3/1958 | Doughty | 273/67 A |
| D. 246,006 | 10/1977 | Burr et al. | D21/210 |
| 1,201,728 | 10/1916 | Henry et al. | 273/81.3 |
| 1,616,377 | 2/1927 | Knight | 273/81.3 |
| 3,326,554 | 6/1967 | Scully | 273/81.3 |
| 4,038,719 | 8/1977 | Bennett | 273/81.3 |

FOREIGN PATENT DOCUMENTS

| | | | |
|---|---|---|---|
| 922750 | 3/1973 | Canada | 273/67 A |
| 20882 | of 1908 | United Kingdom | 273/81 B |
| 2104395 | 3/1983 | United Kingdom | 273/67 DA |

*Primary Examiner*—Richard C. Pinkham
*Assistant Examiner*—Matthew L. Schneider
*Attorney, Agent, or Firm*—Jones, Tullar & Cooper

[57] ABSTRACT

An angular hockey stick handle adapted to fit standard hockey stick shafts to provide an angled gripping portion is disclosed. The handle incorporates a lower socket portion adapted to fit over the end of a conventional hockey stick, and an integral, angled gripping portion intersecting one end of the socket portion at an angle of approximately 130°. The handle is constructed of lightweight plastic and is removably fastened to the hockey stick by means of suitable fasteners.

10 Claims, 8 Drawing Figures

ANGULAR HOCKEY STICK GRIP

This is a continuation-in-part of prior application Ser. No. 552,896, filed Nov. 17, 1983 and now abandoned, which is in turn a continuation-in-part of application Ser. No. 526,288, filed Aug. 25, 1983 and now abandoned.

BACKGROUND OF THE INVENTION

The present invention relates, in general, to auxiliary handles, and more particularly to an auxiliary angled attachment for use as a handle for ice hockey sticks.

Conventional ice hockey sticks are constructed of wood and have a straight handle, or shaft, portion with an angled blade portion at the lower end thereof. The shafts of such devices have a standard cross-sectional dimension and length, although the construction is such that a hockey player can cut the end of the shaft off to adjust the stick to any desired length.

Although the provision of a straight shaft has been conventional on hockey sticks for many years, such sticks are awkward to use, since the straight shaft does not conform to the natural angle of the palm of a player's hand with respect to his forearm, when his hand is closed to grasp the hockey stick and when the wrist is in its natural position. As a result, a player must shorten the shaft so that this wrist will be at a more comfortable angle when the blade is on the surface of the ice. This shortening of the stick, as well as the unnatural angle of the wrist when the stick is being used, detract from the player's ability to drive the hockey puck either for passing or for shooting, and thus limits the puck velocity which the player can obtain. Further, the straight shaft limits a goal tender's ability to handle the stick for blocking shots or for passing the puck.

In spite of the limitations imposed by a straight shaft, it has not been practical to try to shape the end of hockey sticks to better accommodate the natural angle between the user's hand and his forearm, since each player would then require an individualized stick length. With present sticks each player cuts the shaft to the desired length to maximize his comfort and ease of handling. However, the variety of lengths that result from such individualized modifications of the standard stick length precludes the manufacture of individualized shafts. The large number of sizes that would be required in such a situation would greatly increase the expense in manufacturing and stocking the hockey sticks, and would greatly increase their cost.

It is also noted that because of the awkward angle of the hockey stick shaft when the blade is on the ice, players tend to lift the stick to waist level when skating without the puck, and this results in an increased risk of injury not only to the player carrying the stick, but to other players and officials.

SUMMARY OF THE INVENTION

It is, therefore, an object of the present invention to provide a more convenient, more comfortable, and more efficient ice hockey stick.

It is another object of the invention to provide a safer and more natural hockey stick which can be provided in any size without increasing the difficulty or expense of manufacturing the stick itself.

It is a further object of the invention to provide an angular handle attachment that can be fastened to any standard hockey stick after it has been cut to the desired length to thereby provide an improved grip that permits safer, yet more efficient use of the stick.

It is another object of the invention to provide an angled attachment for a hockey stick that will provide a mechanical advantage to improve the velocity at which pucks can be driven.

Briefly, the present invention is directed to an angular grip attachment, or handle, that is adapted to be secured to the end of the shaft of a conventional hockey stick. The handle will fit any standard size stick and is secured thereon to provide an angled grip which provides better control of the stick, improves its comfort and safety, facilitates handling of the stick for defensive purposes, and provides a significant mechanical advantage to the player so that the puck can be driven at a higher velocity. The attachment includes an elongated lower portion having a downwardly opening socket adapted to fit over the end of a hockey stick, and an integral, elongated upper portion formed at the top of the socket portion, extending at an angle with respect thereto, and shaped to form a gripping portion. The axis of the gripping portion interesects the axis of the lower socket portion at an angle of between about 125° and 160°, the angle depending on whether the handle is to be used by a goal tender or by a shooter, so that the user of the attachment is provided with a handle which is angled with respect to the shaft of the hockey stick for an easy and comfortable grip.

The lower socket portion of the handle is provided with suitable apertures for receiving fasteners such as wood screws, bolts or the like which pass into or through the wooden shaft of the stick so that the handle may be securely but removably attached thereto. The handle preferably is constructed of a lightweight, strong plastic material and is molded, for example by injection molding, so that the entire device is formed as a single piece. The gripping portion of the handle has a construction which is generally I-shaped in cross-section to provide lightweight strength.

In a modified form of the invention, the gripping portion may be provided with a honeycomb, or grid, construction consisting of reinforcing ribs formed as an integral part of the gripping portion, for increased strength.

The handle is mounted on the hockey stick after first cutting the conventional shaft to the desired length. The shaft preferably is cut to provide a flat planar end surface which is perpendicular to the axis of the shaft to thereby provide a blunt end in case the grip attachment should become disconnected from the stick during use. The end of the shaft is inserted coaxially into the lower socket portion of the grip attachment and is secured by means of wood screws, bolts, or other suitable fasteners which either extend into or pass through the shaft. Preferably two such fasteners are provided, one on each side of the socket portion and spaced along the length thereof to insure a secure assembly. The resulting angled handle provides an important improvement in hockey stick design, for it allows the hockey player to twist, in a mechanically advantageous manner, the shaft of the stick with his upper hand while defending against a shot or passing or shooting. This twisting motion can be accomplished while the player's hand is at approximately its natural angle with respect to his forearm, thereby permitting improved wrist action, a better mechanical advantage, and a resultant increase in control and, for a shooter, increased puck velocity. The angle of the gripping portion also enables the player to more easily hold the hockey stick in one hand and leads to an increased tendency to keep the blade of the stick at or near the surface of the ice, even when not handling the puck, thereby improving the safety of the players and officials.

The angled grip is constructed of a strong, lightweight plastic and is adapted to be removably connected to a hockey stick so that it can be easily transferred from one stick to another. The handle also allows easy adjustment of the length of the stick shaft, and, since it fits on a standard hockey stick, it does not require any modification of existing hockey stick construction. The attachment can be readily secured to the shaft, and provides a significant improvement in comfort and in the handling characteristics of the stick.

BRIEF DESCRIPTION OF THE DRAWINGS

The foregoing and additional objects, features and advantages of the present invention will become apparent to those of skill in the art from a consideration of the following detailed description thereof, taken in conjunction with the accompanying drawings, in which.

DESCRIPTION OF PREFERRED EMBODIMENTS

Figure 2:
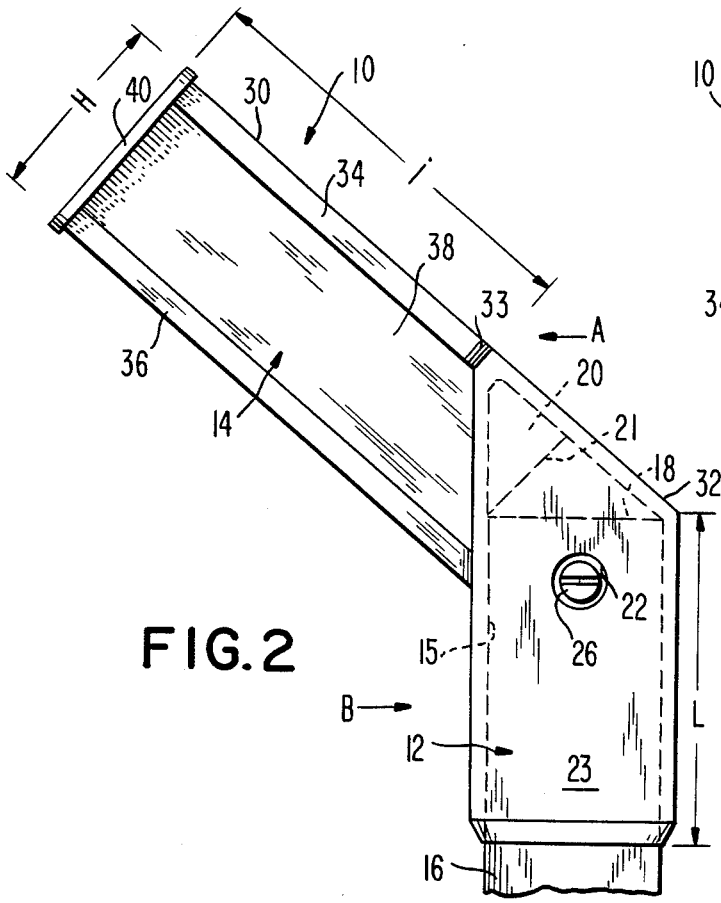
FIG. 2 is a side elevation view of the device of FIG. 1.
Figure 1:
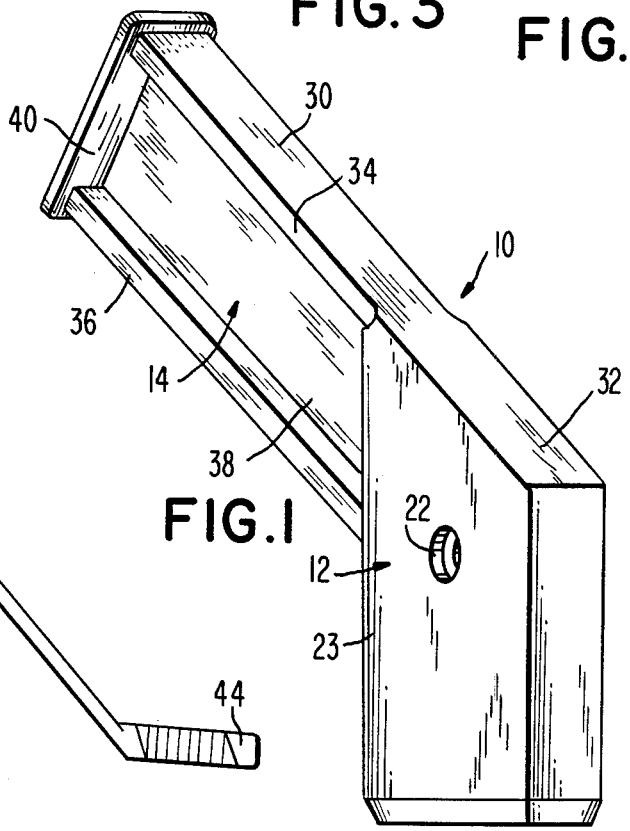
FIG. 1 is a perspective view of a grip attachment construction in accordance with the present invention.

Turning now to a more detailed consideration of the present invention, there is illustrated in FIG. 1 hockey stick grip attachment, or handle, 10 constructed in accordance with the principles of the present invention to provide an angled grip. The handle 10 includes a lower elongated portion 12 and an integral, elongated upper portion 14. The lower portion 12 has a hollow interior which opens downwardly to form a socket 15 adapted to receive the shaft 16 (FIG. 2) of a conventional hockey stick. As indicated, it is preferred that the hockey stick be cut at a right angle to the axial length thereof so as to provide a flat upper surface portion 18, thereby providing a blunt end for the stick in the event that the handle 10 should become dislodged. As shown, the socket 15 formed within the socket portion 12 is shaped to receive the end of the shaft 16 and includes a narrowed top portion 20 defined by interior shoulders 21 to insure that the end of the shaft will be cut at an angle that will not present a danger to the hockey player if the handle 10 is removed.

Figure 3:
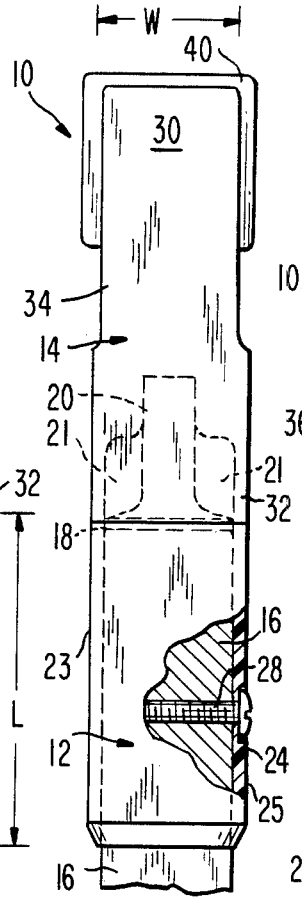
FIG. 3 is a right-hand end view of the device of FIG. 2, looking in the direction indicated by arrow A.
Figure 4:
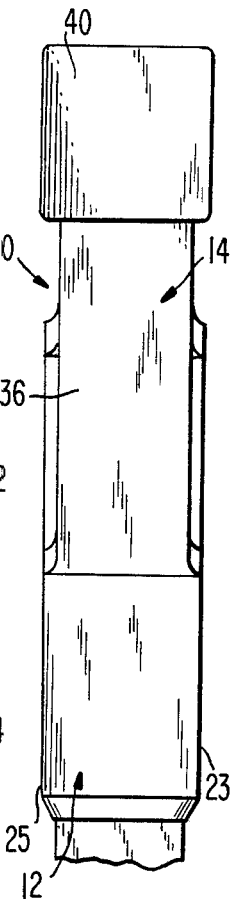
FIG. 4 is a left-hand end view of the device of FIG. 2, taken in the direction of arrow B.

The socket portion 12 may be provided with a spotfaced recess 22 formed in a wall 23 thereof and a recess 24 formed on the opposite wall 25 thereof, the recesses being adapted to receive suitable fasteners such as wood screws 26 and 28. Such recesses permit the fasteners 26 and 28 to be countersunk slightly above, at, or below the outer surfaces of the walls of the socket portion 12, as generally illustrated in the cut-away portion of FIG. 3.

Alternate fasteners may be used to secure the handle onto the end of stock 16; for example, suitable bolts may be used, in which case corresponding recesses may be provided on both sides of the socket portion 12, one receiving the head of the bolt and the other receiving a suitable nut.

In a simplified form of the invention, the recesses may be eliminated from the walls 23 and 25 of the socket portion and are replaced by apertures in the walls of the socket portion to accommodate wood screws or other fasteners. In either case, it may be desired to wrap the exterior of the socket portion with friction tape or the like to cover the heads of the fasteners.

The upper portion 14 of the handle 10 is formed integrally with the lower socket portion 12, and is shaped to form a gripping portion for easy grasping by the hand of the hockey player. The gripping portion 14 intersects the upper end of the socket portion 12, with the top wall 30 of the upper portion being an extension of the sloped top wall 32 of the socket portion 12 and joining wall 32 at a tapered section 33. This taper is located to provide maximum comfort for the user, and thus its exact location is a matter of choice. In the preferred form of the invention illustrated in FIGS. 1 through 4, the longitudinal axes of elongated portions 12 and 14 intersect at an angle of between about 125° and 160°. It has been found that for a goal tender's stick, the preferred angle is about 130°, to give the desired ease of handling. For a shooter's stick, on the other hand, the preferred angle is about 147°, this angle providing the desired wrist angle for providing maximum velocity to a puck when shooting, as well as facilitating stick handling. Although these are the preferred angles, it has been found that the exact angles can be varied without adversely affecting the operation of the handle when applied to the hockey stick, with the preferred range of angles being between 125° and 160°.

The upper portion 14 is shown in the preferred embodiment as having a simple I-beam cross-section which includes upper and lower flanges 34 and 36 and a connecting central web portion 38, with the top surface of the flange 34 being the top wall 30. A flat end plate 40 provides a blunt end to the handle 10. Although the gripping portion 14 is shown as having straight edges and lines, it will be apparent that finger grip indentations, or the like, may be molded into the shape, as desired. Further it will be apparent that the grip portion may be wrapped in friction tape or the like, to provide an improved gripping surface, as desired by the user.

Figure 5:
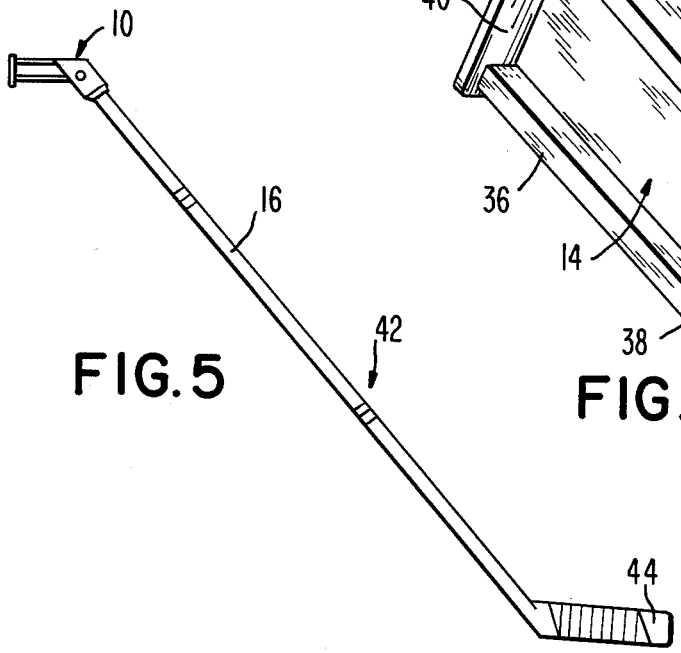
FIG. 5 is an illustration of the device of FIG. 1 mounted on a conventional hockey stick.

As illustrated in FIG. 5, the angular handle 10 is mounted on the shaft portion 16 of a conventional hockey stick 42 which includes at its lower end an angled blade portion 44. As may be seen from the FIG. 5 illustration, the angular handle provides a substantial mechanical advantage to the user in manipulating the stick to defend against shots, or to pass or shoot a puck while maintaining the blade portion 44 generally parallel to the surface of the ice. By carefully cutting the shaft 16 to the proper length, the angle of the grip portion 14 insures that the player can hold the hockey stick with his hand at a natural angle with respect to his forearm so that his wrist is not twisted or angled, while maintaining the blade 44 on or parallel to the surface of the ice. This natural gripping angle permits the wrist to remain flexible and allows the player to manipulate the stick with maximum strength. The angular grip also facilitates one-handed use of the stick and enables the player to keep the blade close to the ice at all times while holding the stick in a natural and comfortable manner. This reduces the lifting of the stick and decreases the risk of injury not only to the player using the stick, but to other players and officials.

The handle 10 is formed from a molded plastic or other synthetic material, preferably in an injection molding process for ease of manufacture. The I-beam construction and the hollow socket structure insure lightness in weight while ensuring sufficient strength to withstand the rigors of hockey play.

Figure 7:
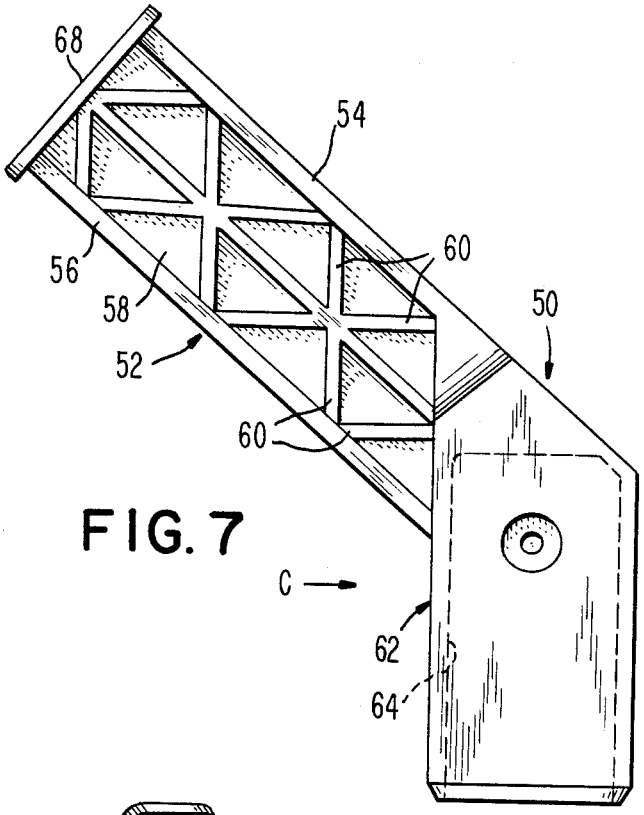
FIG. 7 is a front elevation of the device of FIG. 6.
Figure 8:
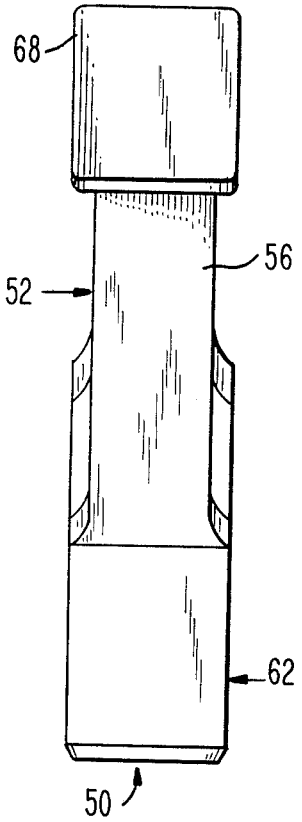
FIG. 8 is a left-side elevation of the device of FIG. 7, taken in the direction of arrow C.
Figure 6:
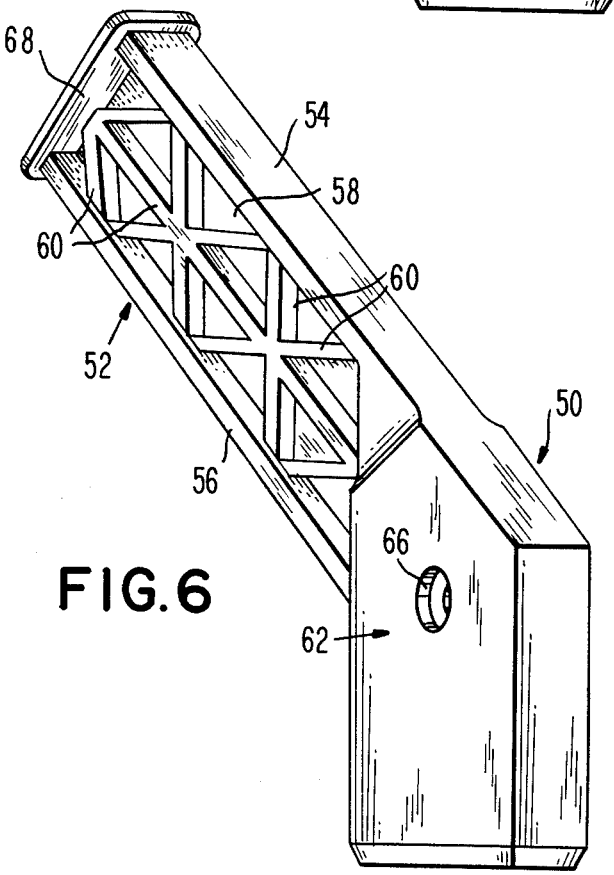
FIG. 6 is a perspective view of a modified form of the device of FIG. 1.

A modified angular handle 50 is illustrated in FIGS. 6, 7 and 8, to which reference is now made. This handle is substantially the same as the handle 10, differing only in the provision of a grid, or honeycombed construction, on the upper gripping portion 52. The gripping portion includes the basic I-beam configuration illustrated in FIG. 1, and thus incorporates upper and lower flanges 54 and 56, as well as a central web portion 58. In addition, a series of reinforcing ribs 60 are formed on the surface of web portion 58 to provide increased torsional and bending resistance for strengthening the grip portion. In this embodiment, the grip 50 includes a lower socket portion 52 having an interior socket 64 adapted to receive a hockey stick in the manner previously described. Suitable recesses, such as the recess 66, are provided for receiving fasteners; a blunt end plate 68 is also provided, all as previously discussed.

In a preferred form of the invention, the lower socket portion of the handle may have a length L (FIG. 2) of between 2 and 4 inches so as to accommodate substantially an equal length of the hockey stick shaft. The interior socket portion is sufficiently large to accommodate a conventional shaft, which is approximately 1 1/32 in. by 25/32 in. in cross-section. The upper integral gripping portion preferably is of the same exterior dimensions as a conventional hockey stick; i.e., 1 1/32 in. in height H (FIG. 2) and 25/32 in. in width W (FIG. 3), and preferably is approximately 4½ in. in length L (FIG. 2) for easy grasping by one hand.

Although the present invention has been described in terms of preferred embodiments, it will be apparent to those of skill in the art that numerous modifications and variations may be made without departing from the true spirit and scope thereof as set forth in the following claims.

What is claimed is:

1. An auxiliary angular hockey stick handle for attachment to the upper end of the shaft of an ice hockey stick for providing improved control of said stick and increased efficiency, comfort, and safety in the use thereof, said handle comprising:

an elongated, rigid, lower handle portion having a first axis and top and bottom ends, said bottom end of said lower handle portion defining a downwardly-opening socket, said lower handle portion and said socket each being generally rectangular in cross-section, said socket being sufficiently large to coaxially receive an upper end of a shaft of an ice hockey stick;

receiving means in said lower handle portion adapted to receive a fastener for securing said lower handle portion to a shaft located within said socket;

an elongated, rigid, upper handle portion having a second axis, said upper handle portion and said lower handle portion being formed in one piece, said upper handle portion being shaped to form a gripping portion having substantially the same nominal cross-sectional dimensions as said socket, said upper handle portion rigidly joined the top end of said lower handle portion so that said first and second axes intersect at a fixed, predetermined angle of between about 125 degrees and about 160 degrees to thereby form an angled gripping portion for a shaft.

2. The auxiliary handle of claim 1, wherein said elongated upper handle portion includes upper and lower spaced flange portions joined by a web portion to define an I-shaped cross-section.

3. The auxiliary handle of claim 2, wherein said upper handle portion further includes angled ribs formed integrally on said web and between said flanges to provide increased strength for said handle.

4. The auxiliary handle of claim 3, wherein said upper and lower handle portions are integrally formed from a molded plastic material.

5. The auxiliary handle of claim 1, further including fastener means cooperating with said receiving means for securing said handle to a shaft in said socket.

6. An ice hockey stick comprising: an elongated shaft having a generally rectangular cross-section, said shaft having a first axis and having first and second ends;

a blade portion secured to a first end of said shaft; and an auxiliary angled hockey stick handle secured to the second end of said shaft for providing improved control of the blade portion and shaft of said hockey stick, said handle including:

(a) an elongated, rigid, lower handle portion having a second axis and having top and bottom ends, said bottom end of said lower handle portion defining a downwardly opening socket, said socket receiving said second end of said shaft with said first and second axes being substantially coaxial;

(b) fastener means for securing said lower handle portion to said second end of said shaft;

(c) an elongated, rigid, upper handle portion having a third axis, said upper handle portion being integral with said lower handle portion to form a single-piece, rigid handle, said upper handle portion being shaped to form a gripping portion having substantially the same nominal cross-sectional dimensions as said shaft, said upper handle portion rigidly joining the top end of said lower handle portion so that said second and third axes intersect at a predetermined fixed angle of between about 125 degrees and about 160 degrees to form an angled gripping portion for said shaft.

7. The ice hockey stick of claim 6, said upper handle portion comprising first and second spaced flanges joined by a web portion to define an I-shaped cross-section.

8. The ice hockey stick of claim 7, said upper handle portion further including angled ribs formed integrally on said web and between said flanges to provide increased strength for said handle.

9. The ice hockey stick of claim 6, wherein said upper and lower handle portions are integrally formed from a molded plastic material.

10. A unitary, rigid, molded handle for attachment to the upper end of the shaft of a hockey stick for providing improved control of the stick and increased efficiency, comfort, and safety in the use thereof, said handle comprising:

an elongated, rigid, lower handle portion having a first axis, said lower handle portion defining a downwardly-opening socket, said lower handle portion and said socket each being generally rectangular in cross-section, said socket being adapted to coaxially receive an upper end of a shaft of a hockey stick;

receiver means in said lower handle portion adapted to receive a fastener for securing said lower handle portion to a hockey stick shaft located in said socket;

an elongated, rigid, upper handle portion having a second axis, said upper handle portion being molded integrally with said lower handle portion to form a single-piece, unitary, rigid handle; said upper handle portion including a pair of spaced flanges joined by a web portion to define an I-shaped cross-section and including reinforcing rib means formed on said web portion and between said flanges, said upper handle portion being shaped to form a gripping portion having substantially the same nominal cross-sectional dimensions as said socket, said upper handle portion rigidly and unitarily joining said lower handle portion so that said first and second axes intersect at a fixed, predetermined angle of between about 125 degrees and about 160 degrees to thereby form an angled handle for gripping a hockey stick.

* * * * *